United States Patent [19]

Powers et al.

[11] Patent Number: 4,641,709

[45] Date of Patent: Feb. 10, 1987

[54] CONTROLLING STEAM DISTRIBUTION

[75] Inventors: Maston L. Powers; Christopher J. Dodson, both of Oklahoma City; John S. Moore, Ponca City, all of Okla.; Farhad Ghassemi, Lafayette, La.

[73] Assignee: Conoco Inc., Ponca City, Okla.

[21] Appl. No.: 735,795

[22] Filed: May 17, 1985

[51] Int. Cl.[4] ..... E21B 47/00; E21B 43/26

[52] U.S. Cl. ..... 166/252; 166/245; 166/271

[58] Field of Search ..... 166/245, 250, 252, 271, 166/308, 272

[56] References Cited

U.S. PATENT DOCUMENTS

| | | | |
|---|---|---|---|
| 2,352,834 | 7/1944 | Hassler . | |
| 2,390,770 | 12/1945 | Barton et al. . | |
| 3,129,761 | 4/1964 | Staadt . | |
| 3,199,587 | 8/1965 | Santourian . | |
| 3,333,633 | 8/1967 | Greenkorn | 166/245 |
| 3,346,048 | 10/1967 | Strange et al. . | |
| 3,434,541 | 3/1969 | Cook et al. | 166/256 |
| 3,515,212 | 6/1970 | Allen et al. | 166/245 |
| 3,565,173 | 2/1971 | Anderson | 166/252 |
| 3,682,244 | 8/1972 | Bowman et al. | 166/252 |
| 3,771,598 | 11/1973 | McBean | 166/245 |
| 3,848,671 | 11/1974 | Kern | 166/272 |
| 3,905,422 | 9/1975 | Woodward | 166/245 |
| 3,999,606 | 12/1976 | Bandyopadhyay et al. | 166/245 |
| 4,071,458 | 1/1978 | Allen | 166/272 |
| 4,129,182 | 12/1978 | Dabbous | 166/263 |
| 4,168,746 | 9/1979 | Sheely | 166/252 |
| 4,182,416 | 1/1980 | Trantham et al. | 166/245 |
| 4,265,310 | 5/1981 | Britton et al. | 166/259 |

*Primary Examiner*—Stephen J. Novosad
*Assistant Examiner*—Bruce M. Kisliuk
*Attorney, Agent, or Firm*—A. Joe Reinert

[57] ABSTRACT

An enhanced oil recovery technique includes the predetermination of a desired steam distribution within a steam flood pattern, which preferably is proportional to the volumes of oil in place within various sectors of an area of a subsurface formation. These sectors are associated with the various producing wells of the steam flood pattern. Initial steam distribution is then determined. Subsequently, one or more of the producing wells has its production rate modified so that the final steam distribution within the formation will more closely approximate the predetermined preferred steam distribution. A preferred technique for stimulating production from a given producing well includes the steps of initially notching and initiating a small unpropped fracture in the formation adjacent the well, then perforating the well over the entire depth of the formation, and subsequently creating a larger propped fracture at that same location after it has been determined that natural steam flow toward the particular producing well is not as great as is desired.

17 Claims, 2 Drawing Figures

CONTROLLING STEAM DISTRIBUTION

BACKGROUND OF THE INVENTION

1. Field of the Invention

The present invention relates generally to enhanced oil recovery techniques, and particularly to techniques for controlling the distribution of an injection fluid, such as steam, throughout an area of a subsurface oil bearing formation to a plurality of producing wells.

2. Description of the Prior Art

It is well known that most oil bearing formations will produce only a relatively small portion of the total oil in place through conventional production techniques. As a result a number of processes have been developed which are referred to as enhanced oil recovery techniques, for producing some of the oil which is left behind after primary production techniques.

One such technique is steam flooding. Steam is injected into a formation to heat and mobilize the oil in the formation and drive that oil toward producing wells. Such techniques are particularly useful in fields where the oil deposits are relatively heavy and viscous.

SUMMARY OF THE INVENTION

The present invention provides an enhanced oil recovery method which is particularly applicable to steam flooding operations.

By the method of the present invention, improved techniques are provided for determining a preferred steam distribution within a steam flood pattern, and for modifying the steam distribution within the pattern so that it more closely approximates the previously determined preferred steam distribution.

A pattern of wells is provided which includes at least one injection well intersecting an underground oil bearing formation for injecting an injection fluid, preferably steam, into an area of the formation surrounding the injection well. The pattern also includes a plurality of producing wells intersecting said area of said formation for producing oil and other fluids from a plurality of sectors of said area. Each of said sectors is associated with one of said producing wells and defines a portion of the area to be drained by its associated producing well.

A preferred steam distribution within each of the sectors of the area is determined by first determining an estimated volume of oil in place in each of the sectors, and thus determining a relative portion of the total oil volume of the area which is in place within each of the sectors. The preferred relative steam distribution is one which is equivalent within each sector to the relative oil distribution within that sector.

Steam is injected into the formation through the injection well. The actual relative portions, of the total volume of injected steam, which are flowing to each of the producing wells are determined by monitoring the relative fluid producing rates of each of the producing wells.

Then, if the actual steam distribution is different from the preferred steam distribution corresponding to the oil in place distribution, the distribution pattern of the injected steam is modified.

This is accomplished by increasing fluid production from producing wells which are not producing the desired proportion of the total injected steam, and by decreasing fluid production from those wells which are determined to be receiving more than their preferred share of the injected steam.

A decrease in fluid production from a given well is accomplished by increasing the fluid level within that well and/or choking the wellhead production line to limit fluid production from that well.

An increase in fluid production from a given producing well is accomplished by pumping down the fluid level in the well to create a pressure sink within the formation adjacent that particular producing well, and if that is not sufficient, a propped frac job is conducted on that producing well.

In anticipation of the potential need for performing a propped frac job on a given well, that well preferably is initially notched through hydraulic jetting or the like and an initial relatively small unpropped horizontal fracture is created within the formation at the notch and then allowed to reclose before the steam injection operation is begun. Then, the well is perforated over the entire depth of the formation. Then, if it later is necessary to perform a propped frac job on that particular well, it is assured that the propped fracture will be created at the location of the initial unpropped fracture, yet this is accomplished without initially influencing the flow of injected steam toward this particular producing well. Also, by perforating the well over the entire depth of the formation, that entire depth is drained.

Through the use of these techniques, an improved steam flood method is provided which significantly increases or enhances the recovery of oil from the formation.

An object of the invention is to provide improved enhanced oil recovery methods, such as steam flood operations or other operations involving injected fluid, by distributing the steam or other injected fluid in a preferred manner that overcomes initial flow tendencies within the formation such as are created by non-homogenous oil saturation distributions and/or non-homogenous rock properties within the formation.

Another object is to provide an improved method of stimulating a producing well during a steam flood operation.

Numerous other objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

In a typical enhanced oil recovery project utilizing injected steam to heat and move viscous oil deposits to producing wells, a pattern of wells is generally utilized having a plurality of producing wells surrounding one or more injection wells.

Figure 1:
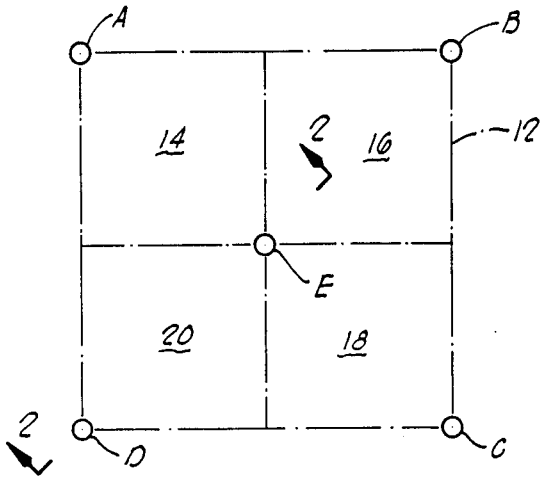
FIG. 1 is a schematic plan view of an inverted five spot pattern including one injection well and four producing wells for a steam flood project.

FIG. 1 illustrates what is commonly referred to as an inverted five spot pattern having four producing wells A, B, C and D which are located at the four corners of a square, with a single injection well E located in the center of the square.

Figure 2:
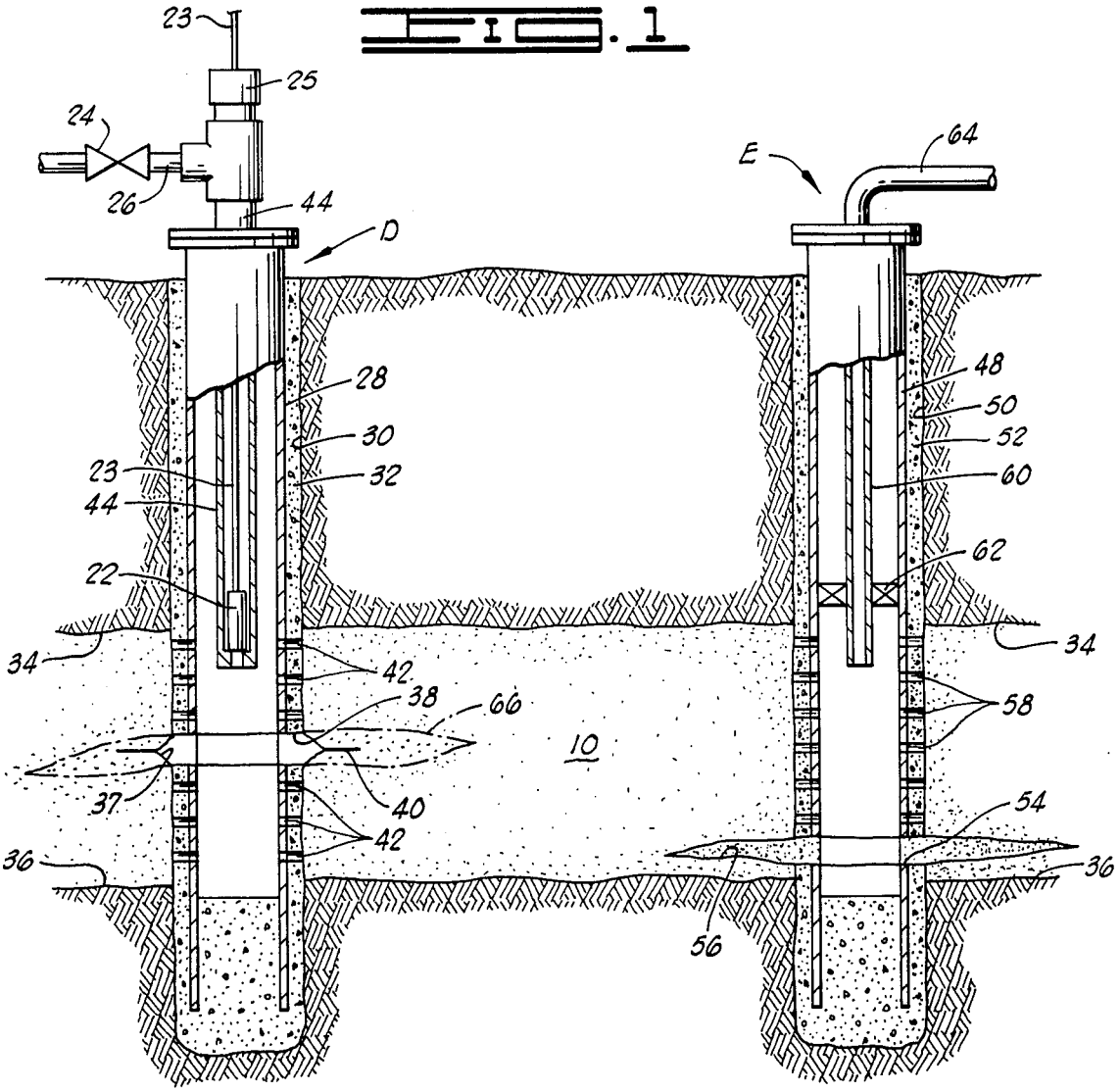
FIG. 2 is a somewhat schematic sectioned elevation view taken along line 2—2 showing the injection well and one of the producing wells along with the various associated subsurface strata.

FIG. 2, which is a somewhat schematic elevation section view taken along line 2—2 of FIG. 1. shows the producing well D on the left and the injection well E on the right.

Each of the wells A, B, C, D and E intersects an underground oil bearing formation 10. The purpose of the injection well E is to inject steam or in some instances other fluids into the formation 10 and to cause oil contained within formation 10 to move toward and be produced from the producing wells such as D.

In FIG. 1, an imaginary area of formation 10 in a square shape defined at its corners by the four producing wells A–D is shown in phantom lines and designated by the numeral 12. Further, phantom lines divide the area 12 into a plurality of sectors 14, 16, 18 and 20 associated with the producing wells A, B, C and D, respectively. Each of the sectors 14, 16, 18 and 20 is associated with one of the producing wells and defines a portion of the area 12 of formation 10 to be drained by its associated producing well.

As will be understood by those skilled in the art, steam flow from injection well E is not totally confined to area 12. Generally, however, the flow of steam is confined within area 12 by a combination of natural barriers which may exist and/or injection of back-up water into surrounding wells to prevent any significant flow of steam outside of area 12.

DETERMINING THE PREFERRED STEAM DISTRIBUTION

A particular problem to which the present invention is directed is that of poor distribution of steam within the pattern represented in FIG. 1. Such problems are particularly acute when, as is often the case, there have been water flood secondary recovery operations performed prior to the steam flood operations.

Due to such prior water flood operations and/or natural non-homogenous conditions occurring within the formation 10, the steam injected into well E will generally follow channels through the formation 10 which provide the least resistance to steam flow. Generally these channels will be through depleted zones and will avoid zones of high oil saturation where in fact it is most desired to direct the steam.

Furthermore, even if the properties of reservoir 10 are such that steam does flow evenly into the four sectors 14, 16, 18 and 20, that still may not be the most effective distribution of steam to achieve the maximum oil recovery.

It has been determined that the most efficient use of steam in a steam injection process is accomplished if the steam is distributed throughout the various sectors 14, 16, 18 and 20 of area 12 of formation 10 in the same proportions as oil is present within those sectors. This is preferable to an uncontrolled distribution, to an even distribution within the sectors when oil is not evenly distributed, and to a steam distribution based on reservoir pore volume distribution.

The preference for distributing steam based on the volume of oil in place as opposed to the reservoir pore volume can be illustrated with a simple thought experiment. Consider two blocks of rock of equal pore volume connected to a common steam injection well. For the first case, let both blocks of rock have the same oil saturation so that they contain equal volume of oil (hydrocarbon pore volumes). In this case, it would be desirable for both blocks to receive equal quantities of steam. This satisfies the distribution based on reservoir pore volume as well as one based on hydrocarbon pore volume. In the second case, let one block contain recoverable hydrocarbons and the other be devoid of any oil. In this case, it would be desirable to direct all of the steam to the block containing the hydrocarbons. This satisfies a desired steam distribution based only on hydrocarbon pore volume. A distribution based on reservoir pore volume would in the second case allow steam to move into the block where no oil exists and would be a waste of the investment in the steam. Consequently, when variations in oil saturation might exist, as is often the case in a previously water flooded formation, the desired steam distribution should be based on the distribution of hydrocarbon within the steam flood pattern.

Thus, the first step in determining the desired relative proportions of steam distribution within the sectors 14, 16, 18 and 20, is to determine the estimated volume of oil in place within each sector, which can be accomplished by conventional reservoir analyses and engineering calculations. This is then converted to a desired steam distribution as shown by the following example.

EXAMPLE

Consider an inverted five spot pattern as illustrated in FIG. 1 with available information obtained from reservoir analyses and engineering calculations showing the respective estimated volumes of oil in place within the sectors 14, 16, 18 and 20 as shown in the following Table I.

TABLE I

| Sector | Estimated Volume of Oil In Place (bbls) |
|---|---|
| 14 | 10,000 |
| 16 | 30,000 |
| 18 | 40,000 |
| 20 | 35,000 |

The desired steam distribution is then determined by dividing the estimated sector oil in place by the total estimated volume of oil in place within the entire area 12 which gives a desired steam distribution to each sector as a percentage of total injected steam as shown in the following Table II.

TABLE II

| Sector | Desired Steam Distribution |
|---|---|
| 14 | 9% |
| 16 | 26% |
| 18 | 35% |
| 20 | 30% |

Assuming a steam injection rate of 1500 B/D (barrels per day), cold water equivalent, and initially assuming that the total volume of fluid produced is equal to the cold water equivalent volume of steam injected, the desired production of fluid from each of the producer wells A, B, C and D would be as shown in the following Table III.

TABLE III

| Sector | Well | Desired Production, B/D |
|---|---|---|
| 14 | A | 1500 × 0.09 = 135 |
| 16 | B | 1500 × 0.26 = 390 |
| 18 | C | 1500 × 0.30 = 450 |
| 20 | D | 1500 × 0.35 = 525 |
| Total | | = 1500 |

The usual situation in a steam flood operation, however, is that the rate of total fluid production from all of the producing wells exceeds the rate at which steam is being injected into the injection well. This is because formation fluids are displaced by steam vapor, at least some of which remains in a vapor phase, and this steam vapor displaces a volume of formation fluids much greater than its cold water equivalent volume. In such a situation the observed total production should also be distributed in proportion to the desired steam distribution percentages. Assuming a total production of 2000 B/D from producing wells A, B, C and D, the desired production for each well is as shown in the following Table IV. These fluids will generally include oil, some formation water, and some condensed steam.

TABLE IV

| Sector | Well | Desired Production, B/D |
|---|---|---|
| 14 | A | 2000 × 0.09 = 180 |
| 16 | B | 2000 × 0.26 = 520 |
| 18 | C | 2000 × 0.30 = 600 |
| 20 | D | 2000 × 0.35 = 700 |
| Total | | = 2000 |

These proportional volumes of fluid being produced from each of the wells will generally correspond to the proportional amount of injected steam which is moving into the sector associated with each well and displacing the produced fluids from those sectors.

This technique just described of determining the relative portion of steam flowing to each of the producing wells A, B, C and D can be more generally described as determining a relative injection fluid portion of a total volume of injection fluid being injected into the area 12 at injection well E which is flowing toward each of the producing wells A, B, C and D.

When a well such as well D, for example, is determined to be producing significantly less than its desired portion of the total produced fluid, one or more of the other wells A, B or C will obviously be producing more than its desired portion of the total produced fluid. Thus, to correct an undesirable steam distribution pattern, a production capability of at least one of the producing wells A, B, C or D must be modified. One or more of those producing wells A, B, C or D which is producing less than its desired portion of the total produced fluid will be pumped down and/or stimulated to increase its production and/or one or more of the wells which are producing more than their desired portion of the total produced fluid will have their fluid production restricted. Such modifying actions will cause the steam distribution within the pattern to change to more closely approximate the desired steam distribution.

It will be appreciated upon reviewing the more detailed explanation of the preferred stimulation and restriction techniques discussed below, that these techniques do not provide precise control of the steam distribution. It often will not be possible to so modify the steam distribution as to have it exactly approximate the previously determined desired steam distribution. Nevertheless, the techniques described below will generally cause the steam distribution to more closely approximate the predetermined desired steam distribution and will thereby increase the overall efficiency of steam flooding of the area 12 to increase the total volume of oil recovered from all of the producing wells A, B, C and D as compared to the total volume of oil which would be recovered in the absence of modifying the production capabilities of at least one of the producing wells.

PRODUCTION RATE MODIFICATION TECHNIQUES

For producing wells located in sectors that are receiving more than the desired portion of injected steam, production modification is relatively easy. In the first instance, fluid production from a well such as well D seen in FIG. 2 is restricted by increasing the production fluid level within the well. This is accomplished by reducing the pumping rate of downhole pump 22 which is operated by a conventional string of sucker rods 23 extending through a stuffing box 25. If the back pressure exerted upon the formation 10 by a full column of fluid within producing well D does not reduce the steam flow to producing well D to the desired level, then production is choked by partially closing a valve 24 in wellhead production line 26. If necessary, the valve 24 can be completely closed to shut in the well D and completely stop production therefrom.

If the portion of injected steam flowing toward well D is lower than the preferred proportion thereof, the first approach to increasing flow toward well D is to pump down the level of fluid within well D as low as possible to create a pressure sink within the formation 10 adjacent the well D. Quite often, however, simply pumping down the fluid level in the non-responding well is not sufficient to draw the desired portion of steam toward that well.

A particularly useful technique has been developed for stimulating a non-responding producing well to increase the proportional flow of injection steam toward that well. This technique involves the initial notching of the well, subsequently performing a small unpropped frac job at the notch, and then perforating the well over the entire depth of formation 10. Later, if necessary, a propped frac job can be performed to stimulate production from the well. This technique can be better understood after the well structure illustrated in FIG. 2 is further described.

The producing well D is defined by a casing 28 which is cemented within a borehole 30 by cement material 32.

The well D intersects the subsurface oil bearing formation 10 which is defined by upper and lower boundaries 34 and 36.

Prior to beginning the steam flood operation, an annular notch 37 is created which extends through casing 28 and the cement material 32 into the formation 10. Notch 37 preferably is located at approximately a middle elevation of the formation 10. The notch 37 can be created in two ways.

The first method of creating notch 37, which is illustrated in FIG. 2, comprises cutting a window 38 through the casing 28 and cement material 32.

The window 38 is preferably approximately three inches in height, and its necessary height is determined by the potential thermal expansion of casing 28. The window 38 should be sufficiently wide that it cannot be closed by subsequent thermal expansion of the casing 28.

The window can be cut with a rotatable hydraulic jetting tool which is lowered into the well on a string of tubing. Such a tool preferably is rotated at an angular velocity of approximately five revolutions per minute while pumping gelled brine containing 1.0 pounds per gallon of 20–40 mesh sand at a rate of approximately five barrels per minute. This process is repeated three additional times, raising the tubing ¾ inch between cuts. Thus, four ¾-inch cuts create a three-inch wide window.

A second manner of creating the notch 37 is by high density perforation techniques. Preferably, an interval of 12 to 18 inches of casing 28 is perforated with a very high perforation density. Although this does not actually sever the casing 28, it will cause a subsequent frac job to occur at the location of the high density perforations, and it will aid in obtaining a horizontal fracture orientation. The term "notch" is used in this application to refer generally to any technique, such as the two just described, which will serve to initiate a horizontal fracture extending radially from a predetermined location on the casing.

Once the notch 37 is created in the well D, by either of the two described techniques, a small unpropped fracture 40 is initiated by pumping from 20 to 200 barrels of fracturing fluid (brine) through the notch 37 into the formation 10. Preferably, about 100 barrels of fracturing fluid are used.

Then, fracturing fluid pressure is released allowing the relatively small unpropped fracture 40 to close as shown in FIG. 2.

Finally, after creating notch 37 and the unpropped fracture 40, the entire depth of formation 1 is perforated as indicated by perforations 42 to facilitate draining of the entire formation 10.

The purpose of this notching and initiation of the small unpropped fracture 40 is to predetermine the location of a possible subsequent propped fracture which may be necessary to stimulate the well.

By the technique of notching and fracturing before perforating, the location of any subsequent propped fracture is predetermined, and also the fracture is at least initiated as a substantially horizontal fracture which is the preferred type of fracture for stimulation of the well.

By allowing the fracture to close back up as shown in FIG. 2, the initial flow of injected steam to well D from injection well E will not be affected.

Then the producing well D is completed with production tubing 44 which receives pump 22 previously mentioned.

Injection well E is similarly constructed from a casing 48, borehole 50 and cement 52.

The well E is notched at 54 near the lower boundary 36 of formation 10, and is hydraulically fractured and propped to create a large propped fracture 56. Then the well E is perforated as indicated at 58 throughout the entire depth of formation 10.

Steam injection tubing 60 is then located within the well and sealed off above formation 10 by packer 62. A steam supply line 64 provides steam to the well E from a conventional source of steam supply.

Preferably, steam is injected into formation 10 at a pressure less than the frac pressure of injection well E, so that the fraction 56 will not open further and allow disruption of the proppant material contained therein.

In a steam injection pattern like that illustrated in FIG. 1, each of the producing wells A, B, C and D that has not previously been fractured is preferably prepared by notching and creating an initial unpropped fracture as shown on well D in FIG. 2. It will be appreciated, however, that if certain ones of the producing wells A, B, C and D have previously been fractured during primary or secondary recovery techniques, it will not be possible to control a subsequent fracturing job in the manner described with regard to well D. This is because those wells which have previously been fractured would refracture at the location of their initial fractures if an attempt was later made to fracture them again.

Thus, the technique described with reference to well D is generally concerned only with wells that have been newly drilled for purposes of the steam flood project, or which in any event have not previously been fractured.

After the steam injection project has begun, and the initial steam distribution is determined in the manner described previously, well D can be stimulated if it is not receiving its desired portion of injected steam by hydraulically fracturing well D to extend the relativey small unpropped fracture 40 to create a larger fracture 66 extending further into the formation as indicated in phantom lines in FIG. 2, and by concurrently propping the fracture 66 with a proppant material to create a larger propped fracture.

This will then stimulate production from the well D and generally will draw more of the injected steam toward well D so that more of the oil in place in sector 20 associated with well D will be heated and caused to be produced.

By combining the various techniques discussed above to cause the distribution of injected steam within the area 12 to more clearly approximate the preferred steam distribution which should be proportional to the relative volumes of oil in place within the various sectors 14, 16, 18 and 20, the total oil produced during the steam injection project will be increased as compared to what it would otherwise be in the absence of the production modification techniques of increasing production from non-responding wells, and decreasing or shutting down production from overly actively responding wells as the case may be.

Thus it is seen that the methods of the present invention readily achieve the ends and advantages mentioned as well as those inherent therein. While certain preferred embodiments of the invention have been illustrated and described above in detail for the purposes of the present disclosure, numerous changes in the arrangement and make-up of the various steps may be made by those skilled in the art, which changes are encompassed within the scope and spirit of the present invention as defined by the appended claims.

What is claimed is:

1. In an enhanced oil recovery method comprising steps of:

(a) providing a pattern of wells, including at least one injection well intersecting an underground oil bearing formation for injecting an injection fluid into an area of said formation surrounding said injection well, and including a plurality of producing wells intersecting said area of said formation for producing oil and other fluids for a plurality of sectors of said areas, each of said sectors being associated with one of said producing wells and defining a portion of said area to be drained by its associated producing well;

(b) injecting injection fluid into said formation through said injection well;

the improvement comprising:

(c) determining an estimated volume of oil in place in each of said sectors, and thus determining a relative oil portion of a total area oil volume which is in place in each of said sectors;

(d) determining a relative injection fluid portion of the total amount of injection fluid being injected into said area which is flowing toward each of said producing wells;

(e) then modifying a production capability of at least one of the group of wells comprising and producing wells and said at least one injection well and thus changing the relative injection fluid portion which stimulates production at least two of said producing wells to more closely approximate stimulation of production at the other production wells responsive to the relative oil portions of the sectors associated with said at least two producing wells; and (f) thereby increasing a total volume of oil recovered as compared to the total volume of oil which would have been recovered in the absence of step (e).

2. The method of claim 1, wherein:

said step (e) is further characterized in that subsequent to said modifying step, the relative injection fluid portion of each of said plurality of producing wells approximates the relative oil portion of the sector associated therewith and wherein the production capacity of at least one of said production wells is modified.

3. The method of claim 2, wherein:

said step (e) is further characterized in that said modifying step includes a step of restricting fluid production from said at least one producing well.

4. The method of claim 3, wherein:

said step (e) is further characterized in that fluid production is restricted from said at least one producing well by increasing a liquid level within said at least one producing well.

5. The method of claim 3, wherein:

said step (e) is further characterized in that fluid production from said at least one producing well is restricted by choking a production fluid outlet from said at least one producing well.

6. The method of claim 2, wherein:

said step (e) is further characterized in that fluid production from said at least one producing well is increased by pumping down a liquid level within said at least one producing well to create a pressure sink within said formation adjacent to said at least one producing well.

7. The method of claim 2, wherein:

said step (e) is further characterized in that said modifying step includes a step of stimulating said at least one producing well to increase fluid production therefrom.

8. The method of claim 7, wherein:

said step of stimulating said at least one producing well is further characterized as inducing a fracture from said at least one producing well into said formation and propping said fracture with a proppant material thus creating a propped fracture.

9. The method of claim 8, comprising the improvement which further comprises the steps of:

prior to step (b):

creating an annular notch extending from said at least one producing well into said formation;

initiating a relatively small unpropped fracture from said notch into said formation;

releasing fracturing fluid pressure and allowing said relatively small unpropped fracture to close; and then perforating said at least one producing well over the entire depth of said formation;

so that a location of the propped fracture created in step (e) is predetermined by the location of said notch without influencing an initial relative injection fluid portion directed to said at least one producing well while still accomplishing draining of the entire depth of said formation.

10. The method of claim 9, wherein:

said initiating step is further characterized in that an amount of fracturing fluid forced into said relatively small unpropped fracture is in the range of 20 to 200 barrels.

11. The method of claim 10, wherein said amount of fracturing fluid is approximately 100 barrels.

12. The method of claim 2, wherein said injection fluid is steam.

13. The method claim 2, wherein:

Step (d) includes a step of determining a relative portion of total produced fluid, produced from all of said producing wells, which is being produced by each of said producing wells.

14. An enhanced oil recovery method comprising steps of:

(a) providing a pattern of wells, including at least one injection well intersecting an underground oil bearing formation for injecting an injection fluid into an area of said formation surrounding said injection well, and including a plurality of producing wells intersecting said area of said formation for producing oil and other fluids from said area;

(b) creating an annular notch extending from at least one of said producing wells into said formation;

(c) initiating a relatively small unpropped fracture from said notch into said formation;

(d) releasing fracturing fluid pressure and allowing said relatively small unpropped fracture to close;

(e) perforating said at least one producing well over the entire depth of said formation;

(f) whereby a location of a potential subsequent propped fracture is predetermined by the location of said notch without initially influencing any tendency of said injection fluid to flow from said injection well to said at least one producing well, while still accomplishing draining of the entire depth of said formation;

(g) injecting injection fluid into said formation through said injection well;

(h) determining an extent to which said at least one producing well is initially responding to the injecting of injection fluid into the formation;

(i) then stimulating production from said at least one producing well by hydraulically fracturing said at least one producing well to extend said relatively small unpropped fracture and propping the same with a proppant material to create a larger propped fracture extending further into said formation; and (j) thereby increasing a flow of injection fluid from said injection well to said at least one producing well and increasing a production rate of oil from said at least one producing well.

15. The method of claim 14, wherein:

said initiating step is further characterized in that an amount of fracturing fluid forced into said relatively small unpropped fracture is in the range of 20 to 200 barrels.

16. The method of claim 15, wherein said amount of fracturing fluid is approximately 100 barrels.

17. The method of claim 14, wherein said injection fluid is steam.

* * * * *